United States Patent [19]

Murphy et al.

[11] 4,182,928

[45] Jan. 8, 1980

[54] HEATING ELEMENT TERMINAL

[75] Inventors: James E. Murphy, Mesquite; Felix M. Atwood, Richardson; Harold D. McDonald, Mesquite, all of Tex.

[73] Assignee: Square D Company, Palatine, Ill.

[21] Appl. No.: 886,708

[22] Filed: Mar. 15, 1978

Related U.S. Application Data

[63] Continuation of Ser. No. 672,372, Mar. 31, 1976, abandoned.

[51] Int. Cl.[2] ..... H01B 17/26; H05B 3/06

[52] U.S. Cl. ..... 174/153 R; 29/630 R; 219/532; 219/541; 339/220 R; 339/276 T; 339/277 R

[58] Field of Search ..... 174/138 J, 153 R; 339/126 R, 131, 214 R, 214 C, 219 R, 220 R, 220 A, 220 C, 220 L, 220 T, 256 SP, 258 S, 276 R, 276 T, 277 R, 277 C, 278 R, 278 A, 278 T; 338/290, 305, 317, 318, 332; 219/532, 541; 113/119; 29/629, 630 R, 630 A, 630 D

[56] References Cited

U.S. PATENT DOCUMENTS

| | | | |
|---|---|---|---|
| 368,987 | 8/1887 | Wheeler | 339/276 T |
| 1,156,710 | 10/1915 | Rowe | 339/277 R X |
| 2,388,054 | 10/1945 | Hartzell | 174/153 R X |
| 2,417,552 | 3/1947 | Ilker et al. | 174/153 R |
| 2,470,280 | 5/1949 | Ackerman | 339/276 R X |
| 3,943,333 | 3/1976 | Kohjohn et al. | 219/532 |

FOREIGN PATENT DOCUMENTS

| | | | |
|---|---|---|---|
| 1262670 | 4/1961 | France | 174/153 R |
| 667229 | 2/1952 | United Kingdom | 174/153 R |

*Primary Examiner*—Laramie E. Askin

*Attorney, Agent, or Firm*—Harold J. Rathbun; Richard T. Guttman; Ernest S. Kettleson

[57] ABSTRACT

A heating element terminal comprising a tubular conductor extending through the central bore of a two-piece insulating clamp member and an aligned aperture of the heating element frame clamped therebetween. The tubular conductor includes a flattened terminal plate at a first end projecting outwardly of the heating element and at the second opposite end includes a compression sleeve portion extending axially therefrom and projecting inwardly of the heating element. An end of the resistance wire of the heating coil is inserted into the central bore of the inwardly projecting compression sleeve portion which is crimped to secure the end of the resistance wire to the said second end of the terminal. The flattened plate formed at the first end of the terminal is drawn into abutment against the two-piece clamp member, and the second opposite end is similarly flattened at the point immediately adjacent the opposite side of the clamp member. The terminal is thus secured to the insulated two-piece clamp member to prevent substantial axial movement relative thereto, and to hold the two pieces of the member together with the frame of the heating element securely clamped therebetween. The outwardly extending terminal plate is provided with an aperture to receive a screw or other fastening means for connection to a conductor leading to an electrical source.

1 Claim, 13 Drawing Figures

HEATING ELEMENT TERMINAL

This is a continuation, of application Ser. No. 672,372, filed Mar. 31, 1976, now abandoned.

BACKGROUND OF THE INVENTION

This invention relates to the field of terminals for electric heating elements, in which the elements comprise a resistance coil supported within a frame on insulating grommets or disks, and with a terminal projecting outwardly of the frame for connection to an electrical source, the terminal being connected inwardly of the frame to the resistance coil.

In prior art devices, such means as bolts were used as terminals, with the threaded shank extending through the central bore of a two-piece insulating member such as mated ceramic discs and through the aperture of the frame of the heating element sandwiched between the ceramic disks. Lock nuts were provided on each side of the two-piece insulating member for tightening thereagainst to securely clamp the disks together with the frame therebetween, and additional lock nuts were then threaded on the bolt shank to fasten the supply conductor to the bolt end extending outwardly from the frame and to fasten the resistance coil wire to the other bolt end extending inwardly of the heating element frame. Such complicated terminal means are both expensive and time consuming to properly install. A problem also arises with such terminals when the lock nuts are not properly tightened, resulting in a high resistance connection. The lock nuts may even become loose enough for either the external supply conductor or internal resistance wire to become electrically disconnected from the terminal.

The present invention overcomes such disadvantages and problems.

SUMMARY OF THE INVENTION

It is an object of the invention to provide an electric heating element terminal which is inexpensive to make and easy to install in the element as well as to connect to an external supply conductor and the internal resistance wire of the heating element.

It is an object of the invention to provide an electric heating element terminal comprising a tubular conductor having a central bore therein.

It is an object of the invention to provide an electric heating element terminal which simultaneously provides connector means at each opposite terminal end and clamping means to clamp a two-piece insulating clamp member together to hold the element frame therebetween by virture of the same respective compression operations performed at each opposite end of the terminal.

It is an object of the invention to provide an electric heating element terminal comprising a tubular conductor including a flattened end projecting externally for connection to a supply conductor, a compression sleeve end projecting interiorly of the element for connection to the resistance wire, and an intermediate tubular section for projection through an aperture of the element frame and mounting of insulating members thereon to hold said tubular section in insulated relationship with said frame.

DESCRIPTION OF PREFERRED EMBODIMENT

Figure 1:
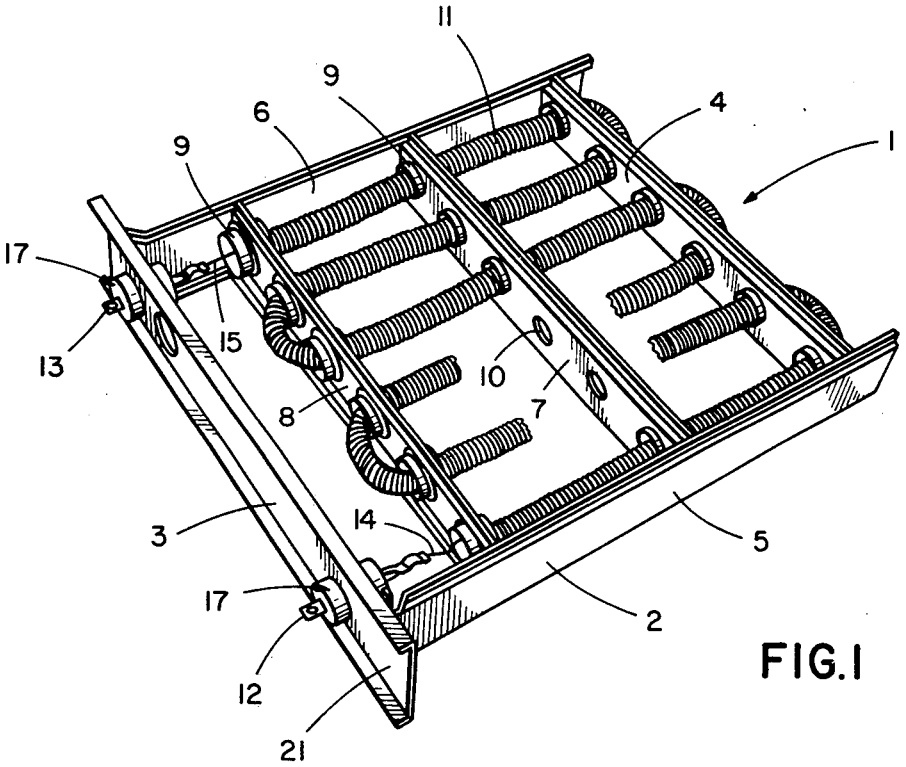
FIG. 1 is a perspective view of an electrical heating element which includes terminals in accordance with this invention.
Figure 2:
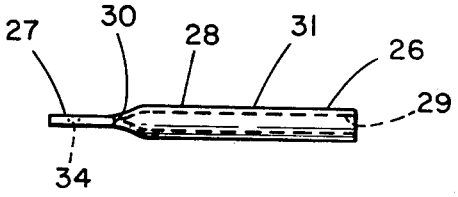
FIG. 2 is a side elevation view of terminal member in accordance with this invention before the compression sleeve end has been crimped.
Figure 3:
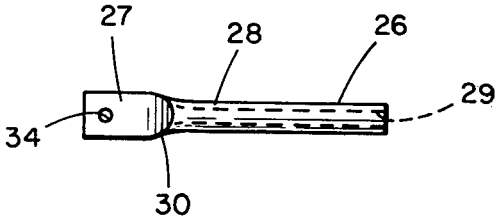
FIG. 3 is a plan view of the terminal member illustrated in FIG. 2.
Figure 4:
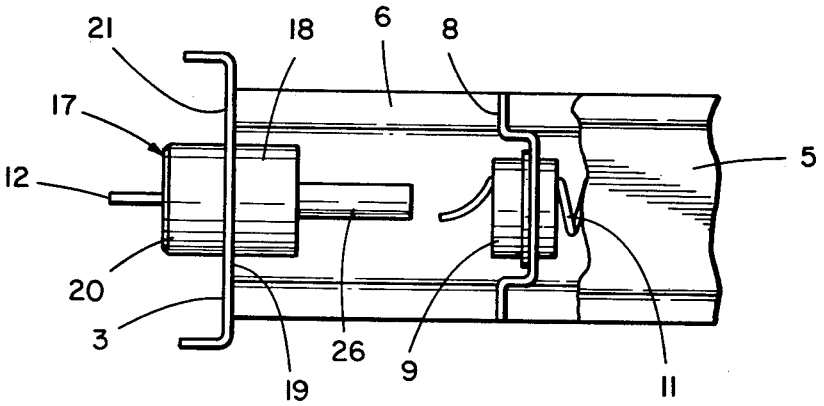
FIG. 4 is a side elevation view of a fragment of the heating element illustrated in FIG. 1, illustrating a terminal member insulatingly supported in a front panel thereof having one end projecting exteriorly for connection to an electrical supply conductor and the opposite end projecting interiorly for connection to the resistance wire of the heating element.
Figure 6:
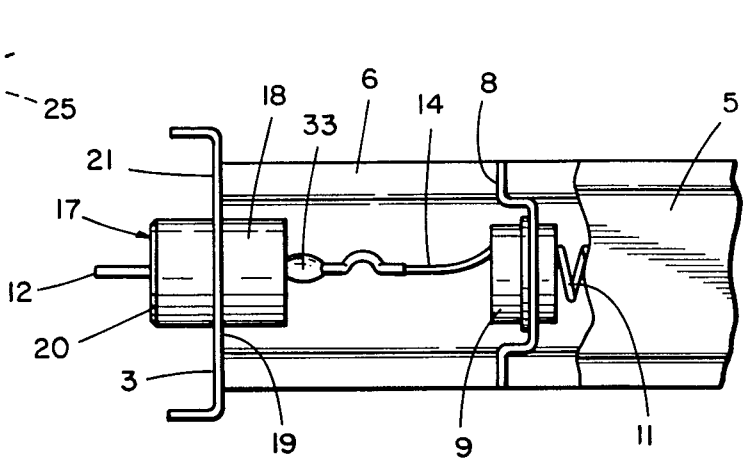
FIG. 6 is a side elevation view of the structure shown in FIG. 4 in which the resistance wire is connected to the terminal member and crimped therein.
Figure 5:
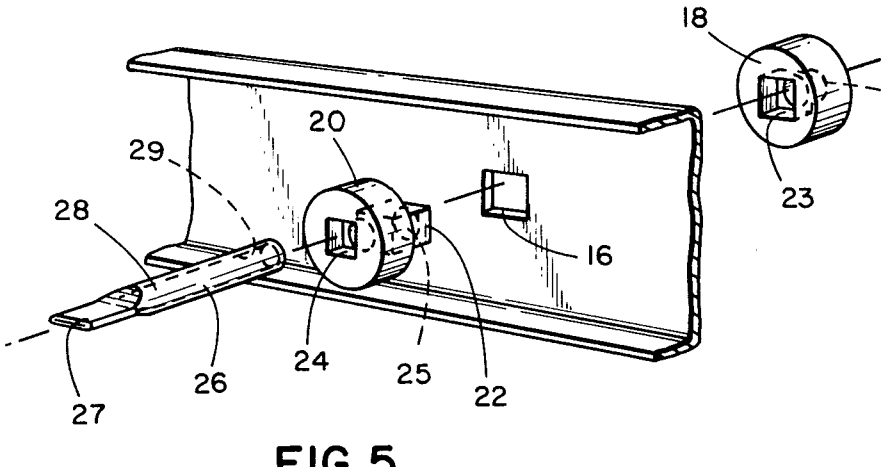
FIG. 5 is an exploded perspective view of a two-piece insulating and clamping member, a fragment of the heating element frame for clamping therebetween, and a terminal member as shown in FIGS. 2 and 3 before insertion through the aligned bores of the two-piece insulating member and aperture of the heating element frame.
Figure 7:
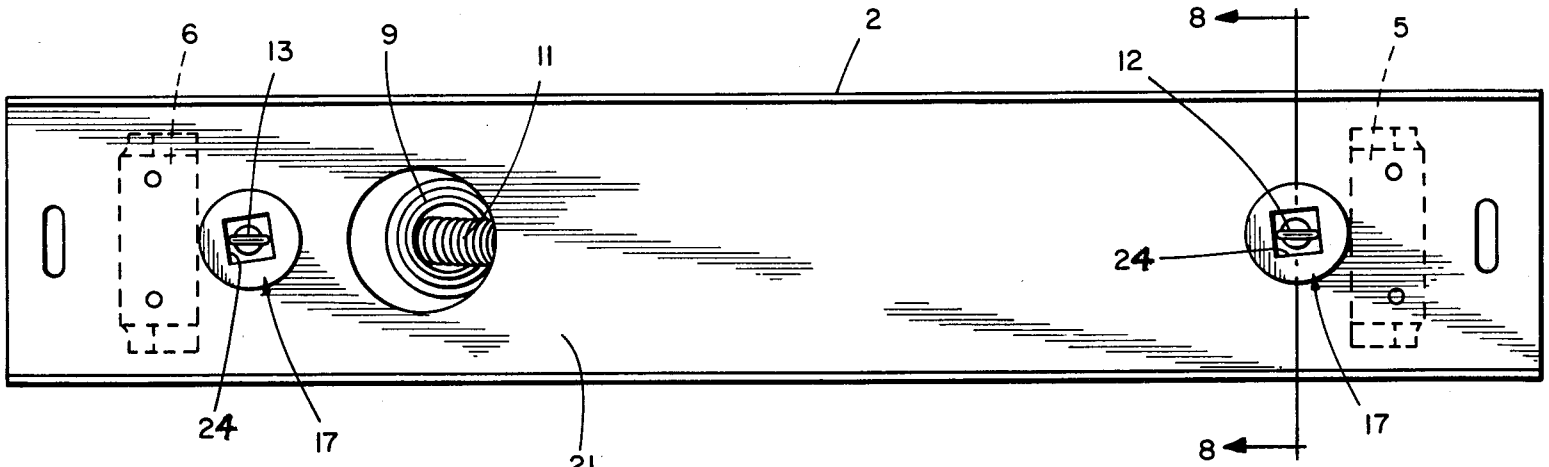
FIG. 7 is a front elevation view of the structure shown in FIG. 6.

An electrical heating element 1 includes a frame 2 having a front panel 3, a rear panel 4, side panels 5 and 6, and lateral panels 7 and 8 spaced apart intermediately between front panel 3 and rear panel 4.

Ceramic insulating grommets 9 are mounted in apertures 10 spaced apart laterally in each lateral panel 7 and 8 and in rear panel 4, each aperture 10 in one panel being axially aligned with the corresponding aperture 10 of the other two of said panels.

A coiled resistance wire 11 extends through said insulating grommets 9 to provide a heating grid when connected to an electrical source at terminals 12 and 13. One end 14 of resistance wire 11 is connected interiorly of the element frame 2 to terminal 12, and the other end 15 of the resistance wire 11 is connected interiorly of the element frame 2 to terminal 13.

Terminals 12 and 13 extend through apertures 16 in front panel 3 of frame 2, and are insulatingly supported therein by an insulating two-piece clamp member 17 comprising a first ceramic disk 18 positioned on the interior facing side 19 of front panel 3, and a second ceramic disk 20 positioned on the exterior facing side 21 of front panel 3.

The insulating ceramic disks of two-piece clamp member 17 are mated together, one having a projecting element centrally thereof and the other having a corresponding recess, so when mated together the two pieces or disks remain in axial alignment. In the embodiments illustrated in the drawing, the ceramic disk 20 positioned on the exterior facing side includes the projecting element 22 and ceramic disk 18 positioned on the interior facing side includes a corresponding recess 23.

The cross-sectional dimension of projecting element 22 corresponds with the dimension of aperture 16 for seating engagement therein and projection therethrough.

Ceramic disk 20 includes an additional recess 24 of angular configuration on the side opposite the side from which projecting element 22 extends.

Each ceramic disk 18 and 20 includes a central bore 25 therethrough, the cross-sectional dimension of the bore 25 being smaller than that of projecting element 22 through which it also extends. Thus, when ceramic disk 20 is positioned adjacent aperture 16 of frame panel 3 with projecting element 22 seated therein and extending therethrough, and ceramic disk 18 is positioned adjacent aperture 16 on the opposite side of frame panel 3 with its recess 23 receiving projecting element 22 therein, the central bores 25 of each disk 18 and 20 are axially aligned to provide a through passageway which is insulated by the ceramic disks 18 and 20 from the frame panel 3.

The two-piece insulating clamp and support members 17 are identical for both of the two apertures 16 in front panel 3 through which terminals 12 and 13 extend. Terminals 12 and 13 are also essentially the same insofar as construction is concerned, and the description of one applies equally to the other.

Terminal 12 comprises a tubular member 26 of copper, or other electrically conductive metal, having a cross-sectional peripheral configuration and dimension corresponding to that of the aligned central bores 25 of ceramic disks 18 and 20, for a relatively snug fit when inserted therethrough with a portion of tubular member 26 extending from both ends of the two-piece members 17. The length of tubular member 26 is such that flattened terminal plate 27 can be formed on the end which projects outwardly or exteriorly of the heating element frame 2 for connection to a line conductor (not shown) and compression sleeve portion 28 can project interiorly of the frame 2 a sufficient distance to be crimped by a crimping tool (not shown) after end 14 of resistance wire 11 has been inserted into the bore 29 of tubular member 26. When so crimped, the resistance wire is securely connected both electrically and mechanically to the terminal 12.

The tubular member 26, on which flattened terminal plate 27 has first been formed by a crimping or compressing operation, is inserted through the aligned central bores 25 of disks 18 and 20 until the inner edges 30 of terminal plate 27 which extend laterally beyond the peripheral wall 31 of tubular member 26 become lodged in angular recess 24 and abut against the edge region of ceramic disk 20 surrounding the entrance to central bore 25.

When compressing or otherwise flattening the end of tubular member 26 to form terminal plate 27, the sides thereof flare outwardly as a result of such flattening and thus extend laterally or radially beyond the peripheral wall 31 of the remaining unflattened portion of tubular member 26.

Figure 8:
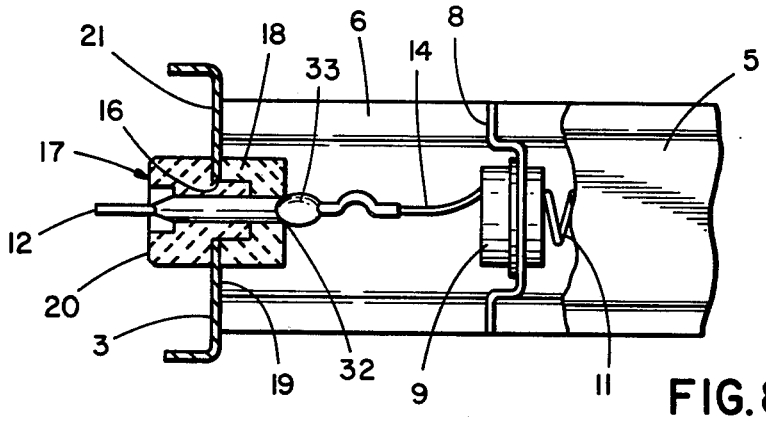
FIG. 8 is a section taken on line 8—8 of FIG. 7.

After tubular member 26 has been fully inserted through the aligned central bores 25 of the mated two-piece insulating member, with front panel 3 of the frame 2 sandwiched therebetween, and the end 14 of resistance wire 11 has been inserted into the compression sleeve portion 28 and crimped, the next step is to flatten by crimping, compression or otherwise that portion of tubular member 26 which lies immediately adjacent the entrance region 32 (see FIG. 8) of ceramic disk 18 to central bore 25, and outwardly thereof. Such flattening operation causes the peripheral wall 31 of tubular member 26 to bow outwardly radially beyond the corresponding dimension of central bore 25, thus effectively providing a barrier or locking region 33 on tubular member 26 which prevents axial movement of tubular member 26 relative to the two-piece insulating and clamping member 17 in the direction of withdrawal therefrom. The flattened terminal plate 27 lodged in recess 24 on the opposite side of the said two-piece member 17, and abutting against the edge region of ceramic disk 20 surrounding the entrance to central bore 25 on that side, prevents further axial movement of the terminal member 26 relative to the two-piece member 17 in the direction of insertion therein.

In this manner, when locking region 33 is formed on tubular member 26 in the manner stated, the terminal 12 is effectively locked in place insulated from the frame; and the two-piece insulating and clamping member 17 is effectively clamped together with front panel 3 of the heating element frame 2 clamped therebetween.

The flattening operation which forms the said locking region 33 may be performed by a crimping tool. The same crimping tool may be used to perform the three separate operations of (1) forming the flattened terminal plate 27; (2) crimping the end of resistance wire 11 in the compression sleeve portion 28; and (3) flattening tubular member 26 to form locking region 33. Alternatively, each operation may be performed by a separate tool if desired for a particular purpose or a particular use. For example, the flattened terminal plate 27 may be machined, coined, and shaped to mate with a corresponding connecting element leading from the electrical power source.

An aperture 34 may be provided in terminal plate 27 for connection of a supply conductor thereto by means of a screw or other connecting means.

Figure 9:
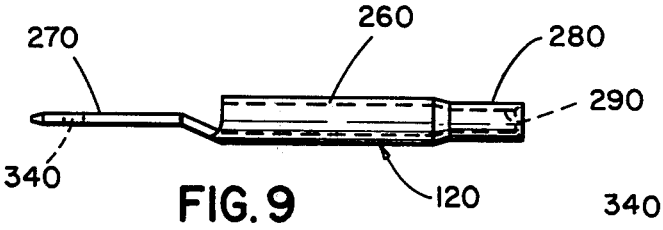
FIG. 9 is a side elevation of a modified terminal member in accordance with this invention.
Figure 11:
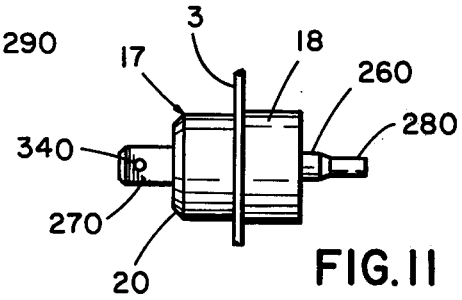
FIG. 11 is a side elevation of a two-piece insulating member, a fragment of a frame panel clamped therebetween, and the modification of the terminal member as shown in FIG. 10.
Figure 10:
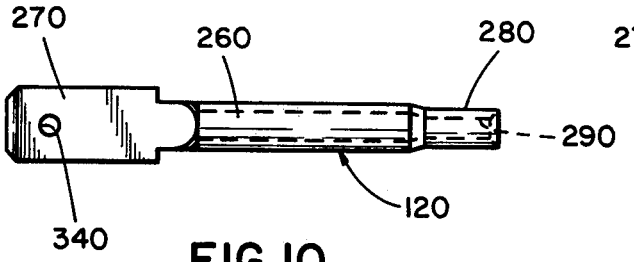
FIG. 10 is a plan view of the terminal member illustrated in FIG. 9.

A modified form of the terminal member in accordance with this invention is shown in FIGS. 9–11.

The terminal member 120 comprises a unitary element of copper, or other electrically conductive metal, having a flat terminal plate 270 at one end, integrally joined to a tubular intermediate portion 260 having a central bore 290 extending therethrough, which is in turn integrally joined to a compression sleeve portion 280 at the opposite end. As illustrated, the compression sleeve portion 280 may be of smaller diameter, or smaller peripheral dimension, than the tubular intermediate portion 260. The flat terminal plate 270 may be formed to lie in a plane which bisects the cross-section of the tubular intermediate portion 260. An aperture 340 may be provided in flat terminal plate 270 to receive a screw or other connecting means for connecting a supply conductor to the terminal plate 270.

The terminal member 120 is supported through apertures 16 of front panel 3 of heating element frame 2, and insulated therefrom, by means of the two-piece insulating and clamping members 17 as described above with reference to terminal member 12. Connection of the end 14 of resistance wire 11 by crimping in compression sleeve portion 280 is likewise done in a manner similar to that described for terminal member 12. That part of tubular intermediate portion 260 lying immediately adjacent the entrance region 32 of ceramic disk 18 is likewise flattened to bow outwardly radially beyond the corresponding dimension of central bore 25 in similar manner to that described for terminal member 12, to effectively lock the terminal member 120 axially in place through the two-piece insulating member 17, and to effectively clamp and hold the two-piece member 17 together with front panel 3 of the heating element frame 2 sandwiched therebetween.

Figure 12:
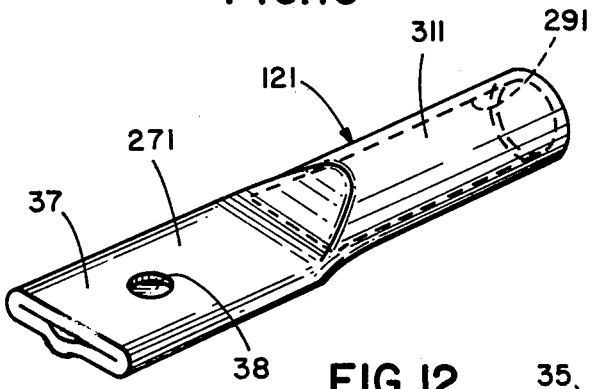
FIG. 12 is a perspective view of another modified terminal member in accordance with this invention, showing one side.
Figure 13:
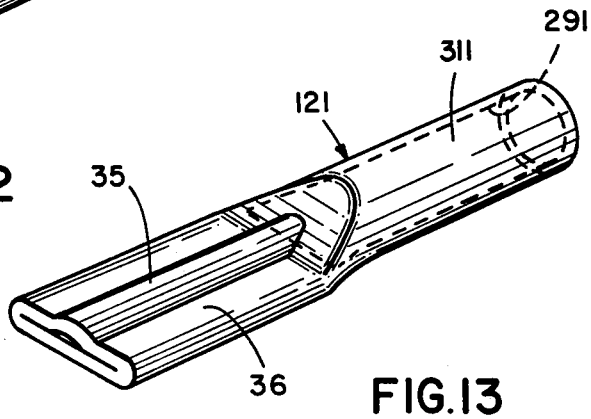
FIG. 13 is a perspective view of the terminal member in FIG. 12 showing the other side.

A further modification of this invention is illustrated in FIGS. 12 and 13. A terminal member 121 is similar to terminal member 12 described above, and its use with two-piece clamp and insulating member 17 for mounting in the front panel 3 of frame 2 is substantially the same as described with respect to terminal member 12. However, the flattened terminal plate 271 of terminal 121 is modified, and includes a longitudinal rib 35 along the midline of surface 36. The opposite surface 37 includes a slight recess or depression 38 in the center region thereof.

The terminal member 121 may be formed from a length of copper tubing or tubing of other electrically conductive metal, having central bore 291 therein. Flattened plate 271 may be formed by pressing the cylindrical wall 311 of the length of tubing together until the interior sides of wall 311 are in mutual contact throughout substantially their full extent and the exterior sides form the substantially flat surfaces 36 and 37. In order to form a terminal member in accordance with this invention by this method, it is desirable to provide a flow region for the excess metal which results from pressing a circular portion of tubing into a flat portion. This flow region in accordance with the invention is provided by longitudinal rib 35 which is formed during the operation of pressing the end of the cylindrical tubing into flattened end plate 271.

The longitudinal rib 35 serves the function of centering terminal 121 when connecting to electrical clips having a corresponding recess or channel to receive the longitudinal rib 35. It also provides increased surface contact with such clips for better frictional hold and improved electrical contact. The depression 38 formed in surface 37 is located to receive a corresponding projection or raised portion formed on the inner surface of such electrical clips, for better retention of the clip on the terminal.

We claim:

1. An electric terminal assembly comprising:

an integrally formed conductive element having a tubular segment and a flat plate at one end thereof, a central bore in said tubular segment being open at the end opposite said flat plate, said tubular segment including an intermediate tubular portion and an end tubular portion for attachment to an electrical conductor, the diameter of said end tubular portion being smaller than that of said intermediate tubular portion, said flat plate being integrally joined to said intermediate tubular portion opposite said end tubular portion, the width of said flat plate being greater than the outer diameter of said intermediate tubular portion;

a two-piece matable insulating assembly, having a central bore for containing said tubular segment, said two-piece matable insulating assembly being in mounting association with a panel member having a predetermined opening, said panel member being clamped between said two-piece matable insulating assembly, said two-piece matable insulating assembly comprising first and second ceramic disks having central bores therethrough, said first disk including a projecting member extending from a clamping side thereof coaxially surrounding said central bore, said second disk including a corresponding recess opening in a clamping side thereof receiving said projecting member therein, said central bore of said two-piece matable insulating assembly providing an insulated passageway through said opening in said panel, the diameter of said insulated passageway being slightly greater than the outer diameter of said intermediate tubular portion of said tubular segment for a snug sliding fit; and wherein said tubular segment is slidingly received in said central bore of said two-piece matable insulating assembly with said end tubular portion projecting from a first end of said two-piece matable insulating assembly, said flat plate projecting from a second end of said two-piece matable insulating assembly with an edge region of said flat plate abutting against a portion of said two-piece matable insulating assembly adjacent said central bore of said two-piece matable insulating assembly, and also wherein an electrical conductor extends into said end tubular portion and said end tubular portion is deformed about said electrical conductor to cause the width of said end tubular portion to increase and be greater than said diameter of said insulated passageway whereby said deformed portion of said end tubular portion provides an abutment against said two-piece matable insulating assembly at said first end while said flat plate provides an abutment against said two-piece matable insulating assembly at said second end thereby holding said two-piece matable insulating assembly together with said panel member clamped between without exerting compressive force against said first and second ends.

* * * * *